US006284706B1

(12) United States Patent
Midorikawa et al.

(10) Patent No.: US 6,284,706 B1
(45) Date of Patent: Sep. 4, 2001

(54) THERMALLY SENSITIVE RECORDING MEDIUM

(75) Inventors: Yoshimi Midorikawa; Kaoru Hamada; Yoshihide Kimura, all of Shinjuku-ku; Tomoaki Nagai, Kita-ku, all of (JP)

(73) Assignee: Nippon Paper Industries Co Ltd, Tokyo (JP)

( * ) Notice: Subject to any disclaimer, the term of this patent is extended or adjusted under 35 U.S.C. 154(b) by 0 days.

(21) Appl. No.: 09/314,166

(22) Filed: May 19, 1999

(30) Foreign Application Priority Data

May 20, 1998 (JP) ..... 10-137899
Aug. 31, 1998 (JP) ..... 10-244567

(51) Int. Cl.[7] ..... B41M 5/30
(52) U.S. Cl. ..... 503/218; 503/204; 503/216; 503/217; 503/218; 503/220; 503/221
(58) Field of Search ..... 503/204, 221, 503/216–218, 220

(56) References Cited

U.S. PATENT DOCUMENTS 4,442,176 4/1984 Nagaoka et al. ..... 503/208
4,824,824 * 4/1989 Matsushita et al. ..... 503/204
5,079,211 * 1/1992 Shimura et al. ..... 503/217
5,246,905 9/1993 Sekine et al. ..... 503/208

FOREIGN PATENT DOCUMENTS 0101741 3/1984 (EP) .
0181698 5/1986 (EP) .

OTHER PUBLICATIONS

Japanese Laid–open Publication 05–278328 (English abstract).

Japanese Laid–open Publication 10–315636 (English abstract).

Japanese Laid–open Publication 09–221832 (English abstract).

* cited by examiner

*Primary Examiner*—Bruce H. Hess

(57) ABSTRACT

The thermally sensitive recording medium having sufficient color developing density and develops sepia color or light brown color. The color difference a* value of developed image of said thermally sensitive recording medium regulated by JIS-Z-8729 is within the region of 0~40 and b* value is within the region of 0~55.

8 Claims, No Drawings

THERMALLY SENSITIVE RECORDING MEDIUM

BACK GROUND OF THE INVENTION

The present invention relates to a thermally sensitive recording medium which develops sepia or light brown color.

DESCRIPTION OF THE PRIOR ART

Generally, the thermally sensitive recording medium possessing a thermally sensitive recording layer mainly comprising a colorless or a pale colored electron donating dye precursor (hereinafter shortened to dye precursor) and a color developer which develops color when heated together with said dye precursor was disclosed in Japanese Patent publication 45-14035 and had been widely utilized practically. As a recording apparatus for this thermal sensitive recording medium, a thermal printer to which a thermal head is installed can be used. The recording method mentioned above has strong points in comparison with other conventional recording methods, namely, noiseless during recording, a developing and a printing procedure are not needed, maintenance free, apparatus is relatively low price and compact and a recorded pattern is very vivid. Therefore, along with the growth of information industry, the application of this method is widely expanded, for instance, applications for a facsimile or a computer, for many kind of measuring equipment and for a label. The developed color image of these thermally sensitive recording media is mainly black color, however, a red color developing type, a blue color developing type, a green color developing type, a full color developing type and a dual color developing type are also well known.

The developed color of thermally sensitive recording medium is comparatively sharp and close to a photograph, and recently used as an output means of image which is taken by a camera attached to a game machine. Accompanied with the extension of uses, a thermally sensitive recording medium which develops neutral color such as sepia color or light brown color is coming to be desired. In the conventional field of thermally sensitive recording medium, it is commonly observed that the developed color changes to sepia or light brown color by the effect of environment such as sun light and temperature, or by the effect of chemicals, however, this color change is a phenomenon which is recognized as a problem caused by poor color preserving. And the thermally sensitive recording medium whose original developed color is sepia or light brown is not developed yet.

The object of this invention is to provide a thermally sensitive recording medium which has a sufficient color density and develops sepia or light brown color.

To accomplish the above mentioned object, a thermally sensitive recording medium is provided having a thermally sensitive color developing layer containing a colorless or a pale colored dye precursor and a color developer as a main component on a substrate, wherein the color difference a* value measured by JIS-Z-8729 of developed image of said thermally sensitive recording medium is 0 to 40, and the color difference b* value measured by JIS-Z-8729 of developed image of said thermally sensitive recording medium is 0 to 55.

The color difference a* value is a parameter which indicates green color, and when the minus value of a* is big, the greenish tone is strong. And when the value approaches 0, the greenish tone becomes weak. Further, plus a* value indicates the reddish tone. Meanwhile, the color difference b* value is a parameter which indicates blue tone and when the minus value of b* is big, the bluish tone is strong. When the value is close to 0, the bluish tone becomes weak, and plus b* value indicates yellowish tone. In the thermally sensitive recording medium of this invention, the color difference a* value of developed image is 0 to 40 and b* value is 0 to 55, and the required sepia or light brown color tone can be obtained. Further, more vivid tone can be obtained when color difference a* value is 0 to 40 and b* value is 3 to 55, more desirably, a* value is 0 to 30 and b* value is 10 to 40. When these color difference values are out of the region regulated in this invention, the color of developed image becomes orange or black and the aimed color tone cannot be obtained.

In addition to a* and b* values in this invention, the color tone can be also obtained by L* value which displays brightness. L* value is not limited in this invention, however, when L* value is too low, color tone becomes dark. Therefore, desirably the practical L* value is 30 to 60, and more desirably is 30 to 50.

In a preferred embodiment, the thermally sensitive recording medium comprises a dye precursor composed by at least one kind of an orange color developing leuco dye whose maximum absorption wave length is 460 to 560 nm and at least one kind of a black color developing leuco dye whose maximum absorption wave lengths are 420 to 480 nm and 550 to 640 run. The maximum absorption wave length of this invention is measured in 99% acetic acid solution. Thus, by the combined use of leuco dyes whose maximum absorption wave lengths are different, the thermally sensitive recording medium which develops sepia color or light brown color can be easily obtained.

In another embodiment, the thermally sensitive recording medium contains 0.05 to 1 parts of black color developing leuco dye whose maximum absorption wave lengths are 420 to 480 nm and 550 to 640 nm to 1 part of orange color developing leuco dye whose maximum absorption wave length is 460 to 560 nm. When the content of black color developing leuco dye is smaller than 0.05 parts to 1 part of orange color developing leuco dye, the color of developed image becomes reddish brown which is the aimed color tone, however, the color density becomes slightly low. This is not a problem in a practical use, however, the contrast of developed image is slightly bad. In the meanwhile, when the content is bigger than 1 part, the contrast of developed image is good, but the color tone becomes slightly dark and looks like dark brown. Therefore, it is desirable to contain the black color developing leuco dye in the above mentioned ratio to the orange color developing leuco dye to obtain the thermally sensitive recording medium whose developed image is vivid sepia or light brown color and the contrast of image is good.

Further, in still another embodiment, the thermally sensitive recording medium contains at least one leuco dye selected from the group composed by 3-cyclohexylamino-6-chlorofluoran and 3-diethylamino-6,8-dimethylfluoran as an orange color developing leuco dye whose maximum absorption wave length is 460 to 550 nm. The use of these leuco dyes is effective to obtain the sepia or light brown color which is the object of this invention.

In another aspect of this invention a thermally sensitive recording medium is provided which displays the developed color image of sepia or light brown color. In this invention, the term of sepia or light brown color means dim and dark neutral tone developing of yellowish red or light brown, which is disclosed, e.g., from page 42 to 51 of "Color one point 10, color naming and it's episode") (Japan Standard Society, issued on Nov. 19, 1993) in items of "13 DULL ORANGE", "14 REDDISH BROWN", "15 BROWN", "16 YELLOWISH BROWN" or "17 GRAYISH BROWN". These colors are expressed as dim yellowish red, dim red, dark red, dark yellowish red and dark gray by JIS common name, or are expressed as cinnamon color, wheat color, fox color, brick color, reddish brown, light brown, nut-brown color, dark-brown color, yellowish brown and earth-brown color by idiomatic color naming. Further, the expression of color becomes different by a subjectivity of inspector or by an illumination, and in this invention, the expression of sepia color or light brown color are typically used to mean commonly expressed sepia or light brown color, however, the invention is not limited to them.

As a leuco dye which develops orange color used in this invention, the leuco dye whose maximum absorption wave length in 99% acetic acid solution is from 460 to 550 nm can be used. As the concrete examples, 3-cyclohexylamino-6-chlorofluoran and 3-diethylamino-6,8-dimethylfluoran can be mentioned, however, the invention is not limited to them. And these leuco dyes can be used together with each other.

As a leuco dye which develops black color used in this invention, the leuco dye whose maximum absorption wave length in 99% acetic acid solution is 420 to 480 nm and 550 to 640 nm can be used. As concrete examples, mention is made of 3-diethylamino-6-methyl-7-anilinofluoran,
3-diethylamino-6-methyl-7-(o,p-dimethylanilino)fluoran,
3-diethylamino-6-methyl-7-(p-chloroanilino)fluoran,
3-diethylamino-6-methyl-7-m-methylanilinofluoran,
3-diethylamino-6-methyl-7-n-octylaminofluoran,
3-diethylamino-6-chloro-7-anilinofluoran,
3-diethylamino-7-(m-trifluoromethylanilino)fluoran,
3-diethylamino-7-(o-chloroanilino)fluoran,
3-diethylamino-7-(o-fluoroanilino)fluoran,
3-diethylamino-6-methyl-7-(p-n-butylanilino)fluoran,
3-dibutylamino-6-methyl-7-anilinofluoran,
3-dibutylamino-6-methyl-7-(o,p-dimethylanilino)fluoran,
3-dibutylamino-7-(o-chloroanilino)fluoran,
3-dibutylamino-7-(o-fuluoroanilino)fluoran,
3-di-n-penthylamino-6-methyl-7-anilinofluoran,
3-di-n-penthylamino-7-(m-trifuluoromethylanilino)fluoran,
3-pyrrolidino-6-methyl-7-anilinofluoran,
3-piperidino-6-methyl-7-anilinofluoran,
3-(N-methyl-N-propylamino)-6-methyl-7-anilinofluoran,
3-(N-methyl-N-cyclohexylamino)-6-methyl-7-anilinofluoran,
3-(N-ethyl-p-toluidino)-6-methyl-7-anilinofluoran,
3-(N-ethyl-N-isoamylamino)-6-methyl-7-anilinofluoran,
3-(N-ethyl-N-tetrahydrofurfurylamino)-6-methyl-7-anilinofluoran,
3-(N-ethyl-N-isobutylamino)-6-methyl-7-anilinofluoran,
3-(N-ethyl-N-ethoxypropylamino)-G-methyl-7-anilinofluoran and
2,4-dimethyl-6-[(4-dimethylamino)anilino]-fluoran, however, the invention is not limited to them. And these leuco dyes can be used alone or can be used in combination.

For the purpose to adjust the color tone, to the thermally sensitive recording medium of this invention, small amount of the well known reddish color developing. leuco dye can be added. As the concrete example of such kind of leuco dye, 3-diethylamino-6-methyl-7-chlorofluoran,
3-diethylamino-benzo[a]fluoran,
3-diethylamino-7-chlorofluoran,
3-diethylamino-7-methylfluoran,
3-N-ethyl-N-isoamylamino-benzo[a]fluoran,
3-N-ethyl-N-p-metylphenylamino-7-methylfluoran,
3-dibutylamino-6-methyl-7-buromofluoran,
3,6-bis(diethylamino)fluoran-γ-(4'-nitro)-anilinolactam,
3,3-bis(1-n-butyl-2-methylindole-3-yl)phthalide,
3,3-bis(1-n-octhyl-2-methylindole-3-yl)phthalide,
3,3-bis(1-ethyl-2-methylindole-3-yl)phthalide and
3,6-bis(diethylamino)fluoran-γ-anilinolactam can be mentioned, however, the invention is not limited to them. And the desirable adding amount is about 0.01 to 0.05 parts to 1 part of the orange color developing leuco dye.

As an organic color developer which can be used in this invention, bis-phenol A type, 4-hydroxyphthalic acid ester type,
4-hydroxyphthalic acid diester type,
phthalic acid monoester type,
bis-(hydroxyphenyl)sulfide type,
4-hydroxyphenylarylsulfone type,
4-hydroxyphenylarylsulfonate type,
1,3-di[2-(hydroxyphenyl)-2-propyl]benzene type,
4-hydroxybenzoyloxybenzoic acid ester type and bisphenolsulfone type which are disclosed in Japanese Patent Laid-Open Publication 3-207688 or Japanese Patent Laid-Open Publication 5-24366, can be mentioned. The typical concrete well known examples are shown below, however, it is not intended to be limited to them. These developers can be used alone or used in combination.

<bisphenol A type>

4,4'-isopropylidenediphenol (another name is bisphenol A),
4,4'-cyclohexylidenediphenol,
p,p'-(1-methyl-n-hexylidene)diphenol,
1,7-di(hydroxyphenylthio)-3,5-dioxaheptane.

<4-hydroxybenzoic ester type>

4-hydroxybenzyl benzoate,
4-hydroxyethyl benzoate,
4-hydroxypropyl benzoate,
4-hydroxyisopropyl benzoate,
4-hydroxybutyl benzoate,
4-hydroxyisobutyl benzoate,
4-hydroxymethylbenzyl benzoate.

<4-hydroxyphthalic acid diester type> dimethyl 4-hydroxyphthalate,
diisopropyl 4-hydroxyphthalate,
dibenzyl 4-hydroxyphthalate,
dihexyl 4-hydroxyphthalate.

<phthalic acid monoesters> monobenzyl phthalate,
monocyclohexyl phthalate,
monophenyl phthalate,
monomethylphenyl phthalate,
monoethylphenyl phthalate,
monopropylbenzyl phthalate, monohalogenbenzyl phthalate,
monoethoxybenzyl phthalate.

<bis-(hydroxyphenyl)sulfide type> bis-(4-hydroxy-3-tert-butyl-6-methylphenyl)sulfide,
bis-(4-hydroxy-2,5-dimethylphenyl)sulfide,
bis-(4-hydroxy-2-methyl-5-ethylphenyl)sulfide,
bis-(4-hydroxy-2-methyl-5-isopropylphenyl)sulfide,
bis-(4-hydroxy-2,3-dimethylphenyl)sulfide,
bis-(4-hydroxy-2,5-dimethylphenyl)sulfide,
bis-(4-hydroxy-2,5-diisopropylphenyl)sulfide,
bis-(4-hydroxy-2,3,6-trimethylphenyl)sulfide,
bis-(2,4,5-trihydroxyphenyl)sulfide,
bis-(4-hydroxy-2-cyclohexyl-5-methylphenyl)sulfide,
bis-(2,3,4-trihydroxyphenyl)sulfide,
bis-(4,5-dihydroxy-2-tert-butylphenyl)sulfide,
bis-(4-hydroxy-2,5-diphenylphenyl)sulfide,
bis-(4-hydroxy-2-tert-octyl-5-methylphenyl)sulfide.

<4-hydroxyphenylarylsulfone type>

4-hydroxy-4'-isopropoxydiphenylsulfone,
4-hydroxy-4'-n-buthoxydiphenylsulfone,
4-hydroxy-4'-n-propoxydiphenylsulfone.

<4-hydroxyphenylarylsulfonates>

4-hydroxyphenylbenzenesulfonate,
4-hydroxyphenyl-p-tolylsulfonate,
4-hydroxyphenylmethylenesulfonate,
4-hydroxyphenyl-p-chlorobenzenesulfonate,
4-hydroxyphenyl-p-tert-butylbenzenesulfonate,
4-hydroxyphenyl-p-isopropoxybenzenesulfonate,
4-hydroxyphenyl-1'-naphthalenesulfonate,
4-hydroxyphenyl-2'-naphthalenesulfonate.

<1,3-di[2-(hydroxyphenyl)-2-propyl]benzene type>

1,3-di[2-(4-hydroxyphenyl)-2-propyl]benzene,
1,3-di[2-(4-hydroxy-3-alkylphenyl)-2-propyl]benzene,
1,3-di[2-(2,4-dihydroxyphenyl)-2-propyl]benzene,
1,3-di[2-(2-hydroxy-5-methylphenyl)-2-propyl]benzene.

<resorcinol type>

1,3-dihydroxy-6(α,α-dimethylbenzyl)-benzene.

<4-hydroxybenzoyloxybenzoic acid ester type>

4-hydroxybenzoyloxybenzyl benzoate,
4-hydroxybenzoyloxymethyl benzoate,
4-hydroxybenzoyloxyethyl benzoate,
4-hydroxybenzoyloxypropyl benzoate,
4-hydroxybenzoyloxybutyl benzoate,
4-hydroxybenzoyloxyisopropyl benzoate,
4-hydroxybenzoyloxytert-butyl benzoate,
4-hydroxybenzoyloxyhexyl benzoate,
4-hydroxybenzoyloxyoctyl benzoate,
4-hydroxybenzoyloxynonyl benzoate,
4-hydroxybenzoyloxycyclohexyl benzoate,
4-hydroxybenzoyloxyβ-phenethyl benzoate,
4-hydroxybenzoyloxyphenyl benzoate,
4-hydroxybenzoyloxyα-naphthyl benzoate,
4-hydroxybenzoyloxyβ-naphthyl benzoate,
4 -hydroxybenzoyloxysec-butyl benzoate.

<bisphenolsulfone type (I)> bis-(3-1-butyl-4-hydroxy-6-methylphenyl)sulfone,
bis-(3-ethyl-4-hydroxyphenyl)sulfone,
bis-(3-propyl-4-hydroxyphenyl)sulfone,
bis-(3-methyl-4-hydroxyphenyl)sulfone,
bis-(2-isopropyl-4-hydroxyphenyl)sulfone,
bis-(2-ethyl-4-hydroxyphenyl)sulfone,
bis-(3-chloro-4-hydroxyphenyl)sulfone,
bis-(2,3-dimethyl-4-hydroxyphenyl)sulfone,
bis-(2,5-dimethyl-4-hydroxyphenyl)sulfone,
bis-(3-methoxy-4-hydroxyphenyl)sulfone,
4-hydroxyphenyl-2'-ethyl-4'-hydroxyphenylsulfone,
4-hydroxyphenyl-2'-isopropyl-4'-hydroxyphenylsulfone,
4-hydroxyphenyl-3'-isopropyl-4'-hydroxyphenylsulfone,
4-hydroxyphenyl-3'-sec-butyl-4'-hydroxyphenylsulfone,
3-chloro-4-hyydroxyphenyl-3'-isopropyl-4'-hydroxyphenylsulfone,
2-hydroxy-5-t-butylphenyl-4'-hydroxyphenylsulfone,
2-hydroxy-5-t-aminophenyl-4'-hydroxyphenylsulfone,
2-hydroxy-5-t-isopropylphenyl-4'-hydroxyphenylsulfone,
2-hydroxy-5-t-octylphenyl-4'-hydroxyphenylsulfone,
2-hydroxy-5-t-butylphenyl-3'-chloro-4'-hydroxyphenylsulfone,
2-hydroxy-5-t-butylphenyl-3'-methyl-4'-hydroxyphenylsulfone,
2-hydroxy-5-t-butylphenyl-3'-isopropyl-4'-hydroxyphenyl sulfone,
2-hydroxy-5-t-butylphenyl-2'-methyl-4'-hydroxyphenylsulfone.

<bisphenolsulfone type (II)>

4,4'-sulfonyldiphenol,
2,4'-sulfonyldiphenol,
3,3'-dichloro-4,4'-sulfonyldiphenol,
3,3'-(dibromo-4,4'-sulfonyldiphenol,
3,3',5,5'-tetrabromo-4,4'-sulfonyldiphenol,
3,3'-diamino-4,4'-sulfonyldiphenol.

<others> p-tert-butylphenol,
2,4-dihydroxybenzophenone,
novolac type phenolic resin,
4-hydroxyacetophenone,
p-phenylphenol,
benzyl-4-hydroxyphenylacetate,
p-benzylphenol.

In the present invention, since the use of a color developer which has plural phenolic hydroxyl groups causes a problem of ground color contamination (ground color developing) by aqueous coating or by humidity in atmosphere, monophenol type color developer is preferably used when more high ground color stability is required. Especially, monophenol sulfone type color developer represented by above mentioned 4-hydroxyphenylarylsulfone contains sulfonyl group in the molecule. A strong electron accepting portion is formed by this sulfonyl group, and indicates strong reactivity with dye precursor and performs an excellent color developing ability, further the obtained thermally recording medium is also superior to the stability of ground color.

In this invention, a conventional well known sensitizer can be used so long as the desired effect of this invention is not prevented. As examples of the sensitizer, stearic acid amide,
palmitic acid amide,
methoxycarbonyl-N-benzamidestearate,
N-benzoylstearic acid amide,
N-eicosenoic acid amide,
ethylene-bis-stearic acid amide,
behenic acid amide,
methylene-bis-stearic acid amide,
methylolamide,
N-methylolstearic acid amide,
dibenzyl terephthalate,
dimethyl terephthalate,
dioctyl terephthalate,
p-benzyloxybenzyl benzoate,
1-hydroxy-2-phenyl naphthoate,
dibenzyl oxalate
di-p-methylbenzyl oxalate,
di-p-chlorobenzyl oxalate,
2-naphthylbenzylether,
m-tarphenyl,
p-benzylbiphenyl,
4-biphenyl-p-tolylether
di(p-methoxyphenoxyethyl)ether
1,2-di(3-methylphenoxy)ethane
1,2-di(4-methylphenoxy)ethane
1,2-di(4-methoxyphenoxy)ethane
1,2-di(4-chlorophenoxy)ethane
1,2-diphenoxyethane
1-(4-methoxyphenoxy)-2-(2-methylphenoxy)ethane
p-methyltiophenylbenzylether
1,4-di(phenyltio)buthane
p-acetotoluidide
p-acetophenetidide,
N-acetoacetyl-p-toluidine,
di-(β-biphenylethoxy)benzene,
p-di(vinyloxyethoxy)benzene,
1-isopropylphenyl-2-phenylethane
1,2-bis(phenoxymethyl)benzene
p-toluenesulfonamide,
o-toluenesulfonamide,
di-p-tolylcarbonate and
phenyl-α-naphtylcarbonate can be mentioned, however, it is not intended to be limited to the compounds. These sensitizers can be used alone or by mixing more than two kinds of them.

As the binder used in the present invention, full saponified polyvinyl alcohol of 200 to 1900 polymerization degree, partial saponified polyvinyl alcohol, denatured polyvinyl alcohol by carboxyl, denatured polyvinyl alcohol by amide denatured polyvinyl alcohol by sulfonic acid, denatured polyvinyl alcohol by butyral modified polyvinyl alcohol, derivatives of cellulose such as hydroxyethyl cellulose, methyl cellulose, ethyl cellulose, carboxymethyl cellulose and acetyl cellulose, copolymer of styrene-maleic anhydride, copolymer of styrene-butadiene, polyvinyl chloride, polyvinyl acetal, polyacrylamide, polyacrylic acid ester, polyvinylbutyral, polystyrene or copolymer of them, polyamide resin, silicone resin, petroleum resin, terpene resin, ketone resin and cumarone resin can be illustrated. These macro molecule compounds can be applied by being dissolved into solvents such as water, alcohol, ketone, ester or hydrocarbon or by being dispersed in water or other medium under an emulsion state or a paste state and these forms of application can be used in combination according to the quality requirement.

In the present invention, it is also possible to add known stabilizers based on metal salts (Ca, Zn) of p-nitrobenzoic acid or metal salts (Ca, Zn) of monobenzylphthalate, which have an effect to endow the recorded image with oil resistance, so long as the desired effect on the object of the present invention is not hindered.

As a filler which can be used in this invention, an inorganic or an organic filler, such as, silica, calcium carbonate, kaoline, calcined kaoline, diatomaceous earth, talc, titanium oxide, zinc oxide, aluminum hydroxide, polystyrene resin, urea-formaldehyde resin, copolymer of styrene-methacrylic acid, copolymer of styrene-butadiene and hollow plastic pigment can be mentioned.

Further, a parting agent such as metallic salt of fatty acid, a slipping agent such as wax, benzophenon- or triazole-based ultra violet absorbers, water proof agent such as glyoxal, dispersing agent, defoamers, anti-oxidation agent and fluorescent dye can be used as an additive.

As a substrate, paper, synthetic paper, plastic film, plastic foam film, non-woven fabrics, recycled paper, metallic foil and a complex (laminate) of these materials can be used.

Further, for the purpose to improve a friction resistance and an image preserving ability, an overcoat layer composed by high polymer composition can be prepared on the surface of thermally sensitive color developing layer. Furthermore, for the purpose to improve the color sensitivity, an undercoat layer containing organic or inorganic filler can be prepared between color developing layer and substrate.

The amount of color developer and dye precursor, the kind and amount of other additives to be used in the thermally sensitive recording medium of this invention are decided according to the required quality and recording feature, and not limited. However, in general, it is preferably to use 0.5 to 4 parts of filler to 1 part of color developer and 5 to 25% of binder to the total amount of solid. When the orange color developing leuco dye whose maximum absorption wave length is 460 to 550 nm and the black color developing leuco dye whose maximum absorption wave length is 420 to 480 nm and 550 to 640 nm as a dye precursor are used, the mixing ratio is decided by the required color tone, however, it is desirable to contain 0.05 to 1 parts of black color developing leuco dye to 1 part of orange color developing leuco dye and the desirable total parts of these leuco dyes is 0.1 to 2 parts to 1 part of organic color developer.

Further, for the purpose to adjust the color tone, reddish color developing leuco dye can be added, and the desirable amount is 0.01 to 0.05 parts to 1 part of orange color developing leuco dye. And, the color tone is slightly changeable by additives such as stabilizer, sensitizer or others, but the effect of it is not so remarkable.

These color developer, dye and other additives which are added at need are ground to fine particles smaller than several microns diameter by means of a pulverizer such as a ball mill, an attriter or a sand grinder, or by means of an adequate emulsifying apparatus, then binder and other additives are added at need, thus the coating is prepared. As a method to apply the coating, a hand coating, a size press coating method, a roll coating method, an air knife coating method, a blend coating method, a flow coating method, a comma direct method, a gravure direct method, a gravure reverse method and a reverse-roll coating method can be mentioned. Further, the method to dry up after sputtering, spraying or dipping can also be used.

EXAMPLES AND COMPARATIVE EXAMPLES (Preparation of Thermally Sensitive Recording Medium)

The spontaneously color changing type thermally sensitive recording medium of this invention is illustrated by following Examples. In Examples, terms of parts and % indicate parts by weight and weight %.

Example 1

Example 1 is an example of the thermally sensitive recording medium of this invention in which 4,4'-isopropyridenediphenol (bisphenol A, shortened to "a" in the following Table 1) is used as a color developer, 3-cyclohexylamino-6-chlorofluoran (shortened to "Or-1" in Table 1) is used as an orange color developing leuco dye whose maximum absorption wave length is 460 to 550 nm and 3-dibutyl-6-methyl-7-anilinofluoran (shortened to "B-1" in Table) is used as a black color developing dye whose maximum absorption wave length is 420 to 480 nm and 550 to 640 nm.

Dispersion of color developer (A solution), dispersion of an orange color developing leuco dye (B solution) and a black color developing leuco dye (C solution) prepared by following blending proportion are separately ground in a wet condition to average diameter of 1 $\mu$m by means of a sand grinder.

| | |
|---|---|
| A solution (dispersion of color developer) | |
| 4,4'-isopropyridenediphenol (a) | 6.0 parts |
| 10% aqueous solution of polyvinylalcohol | 18.8 parts |
| water | 11.2 parts |
| B solution (dispersion of orange color developing leuco dye) | |
| 3-cyclohexylamino-6-chlorofluoran (Or-1) | 1.0 parts |
| 10% aqueous solution of polyvinylalcohol | 2.3 parts |
| water | 1.3 parts |
| C solution (dispersion of black color developing leuco dye) | |
| 3-dibutyl-6-methyl-7-anilinofluoran (B-1) | 1.0 parts |
| 10% aqueous solution of polyvinylalcohol | 2.3 parts |
| water | 1.3 parts |

Then the resulting dispersions are mixed together by the proportion below, stirred and the coating is prepared.

| | |
|---|---|
| A solution (dispersion of color developer [a]) | 36.0 parts |
| B solution (dispersion of orange color developing leuco dye [Or-1]) | 11.04 parts |
| C solution (dispersion of black color developing leuco dye [B-1]) | 2.76 parts |
| Kaoline clay (50% dispersion) | 12.0 parts |

The prepared coating is applied to one side of 50 g/m$^2$ substrate paper and dried up, then the sheet is processed by a super calendar to surface smoothness of 500 to 600 second and the thermally sensitive recording medium of 6.0 g/m$^2$ coating amount can be obtained.

Examples 2–6

The thermally sensitive recording media are prepared by the same procedure as in Example 1. At the preparation of A solution, 4-hydroxy-4'-isoprpoxydiphenylsulfone (shortened to "b"; Example 2),
4-hydroxy-4'-propoxydiphenylsulfone (shortened to "c"; Example 3),
4-hydroxy-4'-buthoxydiphenylsulfone (shortened to "d", Example 4) and
4-hydroxybenzoic acid benzoyl ester (shortened to "e"; Example 5)
4,4'-dihydroxydiphenylsulfone (shortened to "f"; Example 6)

are used instead of 4,4'-isopropyridendiphenyl (a)

Example 7

The thermally sensitive recording medium is prepared by the same procedure to Example 1. As the color developer, 4,4'-isopropyridenediphenol (a) and 4-hydroxy-4'-isoprpoxydiphenylsulfone (b) are used. The mixing proportion of dispersions is mentioned below, mixed, stirred and the coating is prepared.

| | |
|---|---|
| A solution (dispersion of color developer [a]) | 18.0 parts |
| A solution (dispersion of color developer [b]) | 18.0 parts |
| B solution (dispersion of orange color developing leuco dye [Or-1]) | 11.04 parts |
| C solution (dispersion of black color developing leuco dye [B-1]) | 2.76 parts |
| Kaoline clay (50% dispersion) | 12.0 parts |

Examples 8

The thermally sensitive recording medium is prepared by the same procedure as Example 2. At the preparation of B solution, 3-diethylamino-6,8-dimethylfluoran (Or-2) is used instead of 3-cyclohexylamino-6-chrolofluoran (Or-1).

Example 9

The thermally sensitive recording medium is prepared by the same procedure as Example 2. As the orange color developing leuco dye, 3-cyclohexylamino-6-chlorofluoran (Or-1) and 3-diethylamino-6,8-dimethylfluoran (Or-2) is used. The mixing proportion of dispersion is mentioned below, mixed, stirred and the coating is prepared.

| | |
|---|---|
| A solution (dispersion of color developer [a]) | 36.0 parts |
| B solution (dispersion of orange color developing leuco dye [Or-1]) | 5.52 parts |
| B solution (dispersion of orange color developing leuco dye [Or-2]) | 5.52 parts |
| C solution (dispersion of black color developing leuco dye [B-1]) | 2.76 parts |
| Kaoline clay (50% dispersion) | 12.0 parts |

Examples 10~15

The thermally sensitive recording media are prepared by the same procedure as Example 2. At the preparation of C solution, 3-(N-ethyl-N-isoamylamino)-6-methyl-7-anilinofluoran (shortened to B-2; Example 10), 3-diethylamino-6-methyl-7-anilinofluoran (shortened to B-3; Example 11) 3-diethylamino-7-(m-trifluoromethylanilino)fluoran (shortened to B-4; Example 12), 3-diethylamino-6-methyl-7-m-methylanilinofluoran (shortened to B-5; Example 13), 3-(N-methyl-N-propylamino)-6-methyl-7-anilinofluoran (shortened to B-6; Example 14) and 3-di-n-penthylamino-6-methyl-7-anilinofluoran (shortened to B-7, Example 15) are used instead of 3-dibutyl-6-methyl-7-anilinofluoran (B-1).

Example 16

The thermally sensitive recording medium is prepared by the same procedure as Example 2. As the black color developing leuco dye, 3-dibutyl-6-methyl-7-anilinofluoran (B-1) and 3-(N-ethyl-N-isoamylamino)-6-methyl-7-anilinofluoran (shortened to B-2) are used. The mixing proportion of dispersions is mentioned below, mixed, stirred and the coating is prepared.

| | |
|---|---|
| A solution (dispersion of color developer [a]) | 36.0 parts |
| B solution (dispersion of orange color developing leuco dye [Or-1]) | 11.04 parts |
| C solution (dispersion of black color developing leuco dye [B-1]) | 1.38 parts |
| C solution (dispersion of black color developing leuco dye [B-2]) | 1.38 parts |
| Kaoline clay (50% dispersion) | 12.0 parts |

Example 17

The thermally sensitive recording medium is prepared by the same procedure as Example 10. The mixing proportion of dispersions is mentioned below, mixed, stirred and the coating is prepared.

| | |
|---|---|
| A solution (dispersion of color developer [a]) | 36.0 parts |
| B solution (dispersion of orange color developing leuco dye [Or-1]) | 12.88 parts |
| C solution (dispersion of black color developing leuco dye [B-2]) | 0.92 parts |
| Kaoline clay (50% dispersion) | 12.0 parts |

Example 18

The thermally sensitive recording medium is prepared by the same procedure as Example 10. The dispersions are mixed by following mixing proportion, stirred and the coating is prepared.

| | |
|---|---|
| A solution (dispersion of color developer [a]) | 36.0 parts |
| B solution (dispersion of orange color developing leuco dye [Or-1]) | 8.28 parts |
| C solution (dispersion of black color developing leuco dye [B-2]) | 5.52 parts |
| Kaoline clay (50% dispersion) | 12.0 parts |

Example 19

The thermally sensitive recording medium is prepared by the same procedure to Example 10. The each dispersion are mixed by following mixing proportion, stirred and the coating is prepared.

| | |
|---|---|
| A solution (dispersion of color developer [a]) | 36.0 parts |
| B solution (dispersion of orange color developing leuco dye [Or-1]) | 13.34 parts |
| C solution (dispersion of black color developing leuco dye [B-2]) | 0.46 parts |
| Kaoline clay (50% dispersion) | 12.0 parts |

Example 20

The thermally sensitive recording medium is prepared by the same procedure as Example 10. The dispersions are mixed by following mixing proportion, stirred and the coating is prepared.

| | |
|---|---|
| A solution (dispersion of color developer [a]) | 36.0 parts |
| B solution (dispersion of orange color developing leuco dye[Or-1]) | 5.06 parts |
| C solution (dispersion of black color developing leuco dye [B-2]) | 8.74 parts |
| Kaoline clay (50% dispersion) | 12.0 parts |

Example 21

The thermally sensitive recording medium is prepared by the same procedure as Example 10. At the preparation of coating, the dispersion of 3,3-bis(1-n-butyl-2-methylindol-3-il)phthalide which is reddish color developing leuco dye is added. While, the proportion of reddish developing leuco dye to 1 part of orange color developing leuco dye is 0.029 parts.

The reddish color developing leuco dye D solution of following blending proportion is ground in a wet condition to average diameter of 1 $\mu$m by means of a sand grinder.

| D solution (dispersion of reddish color developing leuco dye) | |
|---|---|
| 3,3-bis(1-n-butyl-2-methylindol-3-yl)phthalide (RED) | 1.0 parts |
| 10% aqueous solution of polyvinylalcohol | 2.3 parts |
| water | 1.3 parts |

Then the resulting dispersions are mixed together by the proportion below and the coating is prepared.

| | |
|---|---|
| A solution (dispersion of color developer [a]) | 36.0 parts |
| B solution (dispersion of orange color developing leuco dye[Or-1]) | 11.04 parts |
| C solution (dispersion of black color developing leuco dye [B-2]) | 2.76 parts |
| D solution (dispersion of reddish color developing leuco dye [RED]) | 0.322 parts |
| Kaoline clay (50% dispersion) | 12.0 parts |

Comparative Example 1

The thermally sensitive recording medium is prepared by the same procedure as Example 1. At the preparation of B solution, 3,6-bis(diethylamino)fluoran-γ-(4'-nitro)-anilinolactam (shortened to Red 2) is used instead of 3-cyclohexylamino-6-chlorofluoran(Or-1). The dispersion of Red 2 (D solution) is ground in a wet condition to average diameter of 1 $\mu$m by means of a sand grinder.

| D solution (dispersion of reddish leuco dye) | |
|---|---|
| 3,6-bis(diethylamino)fluoran-γ-(4'-nitro)-anilinolactam (Red 2) | 1.0 part |
| 10% aqueous solution of polyvinylalcobol | 2.3 parts |
| water | 1.3 parts |

Then the resulting dispersions are mixed together by the proportion below and the coating is prepared.

| | |
|---|---|
| A solution (dispersion of color developer [a]) | 36.0 parts |
| D solution (dispersion of reddish color developing leuco dye[Red2]) | 11.04 parts |
| C solution (dispersion of black color developing leuco dye [B-2]) | 2.76 parts |
| Kaoline clay (50% dispersion) | 12.0 parts |

<Method for Estimation >

Using a thermally sensitive printer TH-PMD (product of Ohkura Electric Co., Ltd. Thermally recording paper printing tester in which Kyocera Thermal head is installed) recording tests are carried out on prepared spontaneously color changing type thermally sensitive recording medium by 0.41 mj/dot impressive energy. The color differences a* and b* values, as prescribed in JIS-Z-8729, are measured by color difference meter (NF999; product of Nihon Denshoku Kogyo Co., Ltd.), C standard light regulated by JIS-Z-8720-1983 is used and measured by angle 2 degrees. Further the density of developed color (O.D. in Tables) is measured by Macbeth densitometer (RD-914, blue filter is used). The obtained results are summarized in Table 1 and Table 2.

TABLE 1

Kinds of color developer and dye

| | color | color developing dye | |
|---|---|---|---|
| experiment No. | developer | orange | black |
| Example 1 | a | Or-1 | B-1(0.25) |
| Example 2 | b | Or-1 | B-1(0.25) |
| Example 3 | c | Or-1 | B-1(0.25) |
| Example 4 | d | Or-1 | B-1(0.25) |
| Example 5 | e | Or-1 | B-1(0.25) |
| Example 6 | f | Or-1 | B-1(0.25) |
| Example 7 | a/b | Or-1 | B-1(0.25) |
| Example 8 | b | Or-2 | B-1(0.25) |
| Example 9 | b | Or-1/Or-2 | B-1(0.25) |
| Example 10 | b | Or-1 | B-2(0.25) |
| Example 11 | b | Or-1 | B-3(0.25) |
| Example 12 | b | Or-1 | B-4(0.25) |
| Example 13 | b | Or-1 | B-5(0.25) |
| Example 14 | b | Or-1 | B-6(0.25) |
| Example 15 | b | Or-1 | B-7(0.25) |
| Example 16 | b | Or-1 | B-1/B-2(0.25) |
| Example 17 | b | Or-1 | B-2(0.07) |
| Example 18 | b | Or-1 | B-2(0.67) |
| Example 19 | b | Or-1 | B-2(0.03) |
| Example 20 | b | Or-1 | B-2(1.7) |
| Example 21 | b | Or-1 | B-2(0.25) |
| Comp. Example 1 | b | Red2 | B-2(0.25) |

TABLE 2 a*, b*, tone and density after printed

| experiment No. | a* | b* | color tone | O.D. |
|---|---|---|---|---|
| Example 1 | 17.3 | 19.0 | light brown | 1.28 |
| Example 2 | 11.2 | 14.7 | light brown | 1.30 |
| Example 3 | 8.7 | 12.9 | light brown | 1.25 |
| Example 4 | 12.2 | 15.6 | light brown | 1.24 |
| Example 5 | 9.8 | 17.4 | light brown | 1.26 |
| Example 6 | 11.1 | 14.9 | light brown | 1.29 |
| Example 7 | 13.7 | 16.6 | light brown | 1.30 |
| Example 8 | 12.8 | 15.8 | light brown | 1.28 |
| Example 9 | 12.2 | 16.4 | light brown | 1.29 |
| Example 10 | 16.0 | 15.6 | light brown | 1.32 |
| Example 11 | 15.0 | 14.2 | light brown | 1.26 |

TABLE 2-continued a*, b*, tone and density after printed

| experiment No. | a* | b* | color tone | O.D. |
|---|---|---|---|---|
| Example 12 | 12.5 | 15.2 | light brown | 1.27 |
| Example 13 | 6.0 | 19.5 | light brown | 1.29 |
| Example 14 | 11.9 | 17.4 | light brown | 1.28 |
| Example 15 | 12.5 | 17.6 | light brown | 1.26 |
| Example 16 | 14.3 | 15.1 | light brown | 1.32 |
| Example 17 | 24.6 | 35.4 | reddish brown | 1.16 |
| Example 18 | 7.5 | 6.6 | dark brown | 1.35 |
| Example 19 | 34.7 | 50.6 | reddish brown | 0.95 |
| Example 20 | 4.2 | 1.4 | dark brown | 1.36 |
| Example 21 | 14.3 | 15.0 | light brown | 1.29 |
| Comp. Example 1 | 28.7 | −12.4 | purple | 1.26 |

<Evaluation Results>

Examples 1–20 of this invention, are the examples which use orange color developing leuco dye whose maximum absorption wave length is 460 to 550 nm and black color developing leuco dye whose absorption maximum wave length is 420 to 480 nm and 550 to 640 nm. The color difference a* value of thermally sensitive recording medium of these Examples are within the region of 0 to 40, and that of color difference b* value are within the region of 0 to 55, and the color tone of these Examples are sepia color or light brown. On the contrary, color difference a* value and b* value of Comparative Example 1 are out of the region regulated by this invention and the aimed color can not be obtained.

[Effect of the Invention]

The thermally sensitive recording medium of this invention, has a sufficient color developing density and develops sepia color or light brown color, therefore it is suited to be used in a field where these color tones are desired.

What is claimed is:

1. A thermally sensitive recording medium, comprising a substrate and a thermally sensitive color developing layer carried on said substrate, said layer comprising a colorless or pale colored dye precursor and a color developer, wherein the dye precursor comprises at least one orange color developing leuco dye whose maximum absorption wave length is from 460 to 550 nm and at least one black color developing leuco dye whose maximum absorption wave length is from 420 to 480 nm and 550 to 640 nm.

2. The thermally sensitive recording medium according to claim 1, which comprises from 0.05 to 1 part of said at least one black color developing leuco dye, per 1 part of said at least one orange color developing leuco dye.

3. The thermally sensitive recording medium according to claim 2, wherein said at least one orange color developing leuco dye comprises at least 3-cyclohexylamino-6-chlorofluoran or 3-diethylamino-6,8-dimethylfluoran, or mixture thereof.

4. The thermally sensitive recording medium according to claim 3, wherein said at least one black color developing leuco dye comprises at least one compound selected from the group consisting of:

3-diethylamino-6-methyl-7-anilinofluoran,
3-diethylamino-6-methyl-7-(o,p-dimethylanilino)fluoran,
3-diethylamino-6-methyl-7-(p-chloroanilino)fluoran,
3-diethylamino-6-methyl-7-m-methylanilinofluoran,
3-diethylamino-6-methyl-7-n-octylaminofluoran,
3-diethylamino-6-chloro-7-anilinofluoran, 3-diethylamino-7-(m-trifluoromethylanilino)fluoran,
3-diethylamino-7-(o-chloroanilino)fluoran,
3-diethylamino-7-(o-fluoroanilino)fluoran,
3-diethylamino-6-methyl-7-(p-n-butylanilino)fluoran,
3-dibutylamino-6-methyl-7-anilinofluoran,
3-dibutylamino-6-methyl-7-(o,p-dimethylanilino)fluoran,
3-dibutylamino-7-(o-chloroanilino)fluoran,
3-dibutylamino-7-(o-fuluoroanilino)fluoran,
3-di-n-penthylamino-6-methyl-7-anilinofluoran,
3-di-n-penthylamino-7-(m-trifuluoromethylanilino)fluoran,
3-pyrrolidino-6-methyl-7-anilinofluoran,
3-piperidino-6-methyl-7-anilinofluoran,
3-(N-methyl-N-propylamino)-6-methyl-7-anilinofluoran,
3-(N-methyl-N-cyclohexylamino)-6-methyl-7-anilinofluoran,
3-(N-ethyl-p-toluidino)-6-methyl-7-anilinofluoran,
3-(N-ethyl-N-isoamylamino)-6-methyl-7-anilinofluoran,
3-(N-ethyl-N-tetrahydrofurfurylamino)-6-methyl-7-anilinofluoran,
3-(N-ethyl-N-isobutylamino)-6-methyl-7-anilinofluoran,
3-(N-ethyl-N-ethoxypropylamino)-6-methyl-7-anilinofluoran and
2,4-dimethyl-6-[(4-dimethylamino)anilino]-fluoran.

5. The thermally sensitive recording medium according to claim 1, wherein said at least one black color developing leuco dye comprises at least one compound selected from the group consisting of:

3-diethylamino-6-methyl-7-anilinofluoran,
3-diethylamino-6-methyl-7-(o,p-dimethylanilino)fluoran,
3-diethylamino-6-methyl-7-(p-chloroanilino)fluoran,
3-diethylamino-6-methyl-7-m-methylanilinofluoran,
3-diethylamino-6-methyl-7-n-octylaminofluoran,
3-diethylamino-6-chloro-7-anilinofluoran,
3-diethylamino-7-(m-trifluoromethylanilino)fluoran,
3-diethylamino-7-(o-chloroanilino)fluoran,
3-diethylamino-7-(o-fluoroanilino)fluoran,
3-diethylamino-6-methyl-7-(p-n-butylanilino)fluoran,
3-dibutylamino-6-methyl-7-anilinofluoran,
3-dibutylamino-6-methyl-7-(o,p-dimethylanilino)fluoran,
3-dibutylamino-7-(o-chloroanilino)fluoran,
3-dibutylamino-7-(o-fuluoroanilino)fluoran,
3-di-n-penthylamino-6-methyl-7-anilinofluoran,
3-di-n-penthylamino-7-(m-trifuluoromethylanilino)fluoran,
3-pyrrolidino-6-methyl-7-anilinofluoran,
3-piperidino-6-methyl-7-anilinofluoran,
3-(N-methyl-N-propylamino)-6-methyl-7-anilinofluoran,
3-(N-methyl-N-cyclohexylamino)-6-methyl-7-anilinofluoran,
3-(N-ethyl-p-toluidino)-6-methyl-7-anilinofluoran,
3-(N-ethyl-N-isoamylamino)-6-methyl-7-anilinofluoran,
3-(N-ethyl-N-tetrahydrofurfurylamino)-6-methyl-7-anilinofluoran,
3-(N-ethyl-N-isobutylamino)-6-methyl-7-anilinofluoran,
3-(N-ethyl-N-ethoxypropylamino)-6-methyl-7-anilinofluoran and
2,4-dimethyl-6-[(4-dimethylamino)anilino]-fluoran.

6. The thermally sensitive recording medium according to claim 1, further comprising from about 0.01 to about 0.05 parts of reddish color leuco dye, to 1 part of said at least one orange color developing leuco dye.

7. The thermally sensitive recording medium according to claim 6, wherein said reddish color developing dye is selected from the group consisting of 3-diethylamino-6-methyl-7-chlorofluoran,
3-diethylamino-benzo[a]fluoran,
3-diethylamino-7-chlorofluoran,
3-diethylamino-7-methylfluoran,
3-N-ethyl-N-isoamylamino-benzo[a]fluoran,
3-N-ethyl-N-p-metylphenylamino-7-methylfluoran,
3-dibutylamino-6-methyl-7-buromofluoran,
3,6-bis(diethylamino)fluoran-γ-(4'-nitro)-anilinolactam,
3,3-bis(1-n-butyl-2-methylindole-3-yl)phthalide,
3,3-b s(1-n-octhyl-2-methylindole-3-yl)phthalide,
3,3-bis(1-ethyl-2-methylindole-3-yl)phthalide and
3,6-bis(diethylamino)fluoran-γ-anilinolactam.

8. The thermally sensitive recording medium according to claim 1, wherein said color developer is at least one type of organic color developer selected from the group the group consisting of bisphenol A compounds, 4-hydroxyphthalic acid ester compounds, 4-hydroxyphthalic acid diester compounds, phthalic acid monoester compounds, bis-(hydroxyphenyl)sulfide compounds, 4-hydroxyphenylarylsulfone compounds, 1,3-di[2-(hydroxyphenyl)-2-propyl]benzene compounds, 4-hydroxybenzoyloxybenzoic acid ester compounds and bisphenolsulfone compounds.

* * * * *